US005472210A

United States Patent [19]

Fioravanti

[11] Patent Number: 5,472,210

[45] Date of Patent: Dec. 5, 1995

[54] ADAPTABLE BINGO CARD MARKING STENCIL

[76] Inventor: Anthony Fioravanti, 5360 Marengo Ave., No. 35, La Mesa, Calif. 91942

[21] Appl. No.: 261,189

[22] Filed: Jun. 13, 1994

[51] Int. Cl.[6] ..... A63F 3/06

[52] U.S. Cl. ..... 273/269; 273/148 R

[58] Field of Search ..... 273/148 R, 240, 273/269; 446/901; 283/901, 903

[56] References Cited

U.S. PATENT DOCUMENTS

| | | | |
|---|---|---|---|
| 4,618,151 | 10/1986 | Fadner et al. | 273/269 |
| 5,310,191 | 5/1994 | Booth | 273/269 |

FOREIGN PATENT DOCUMENTS

| | | | |
|---|---|---|---|
| 0431252 | 6/1981 | European Pat. Off. | 273/269 |
| 0431236 | 6/1991 | European Pat. Off. | 273/269 |
| 2480614 | 10/1981 | France | 273/269 |
| 2907552 | 8/1980 | Germany | 273/148 R |
| 3028710 | 2/1982 | Germany | 273/148 R |
| 3235783 | 3/1984 | Germany | 273/148 R |

*Primary Examiner*—Vincent Millin
*Assistant Examiner*—William M. Pierce
*Attorney, Agent, or Firm*—John R. Duncan; Frank D. Gilliam

[57] ABSTRACT

A bingo playing aid for use in playing bingo games involving an unusual game pattern and a method of playing bingo using that playing aid. A stencil has a linear array of at least two bingo card patterns corresponding to the spacing of bingo patterns on a playing sheet in either rows or columns. Each of the card patterns on the stencil has perforations surrounding each number location, with the outermost row in each pattern in the direction of the linear array preferably having greater lengths. Selected perforated areas are removed to leave a pattern of openings corresponding to the game pattern to be played. The stencil is placed over the playing sheet and each number called that appears in a stencil opening is marked. When all numbers showing on a card have been marked, the player wins. Preferably, a thin layer of pressure sensitive adhesive is placed on the playing sheet or the back of the stencil between card patterns to hold the stencil in place when placed on the playing sheet. Since ink markers or daubers are generally used for marking called numbers, the stencil preferably has a plastic surface so that any ink on the surface can be wiped away.

5 Claims, 1 Drawing Sheet

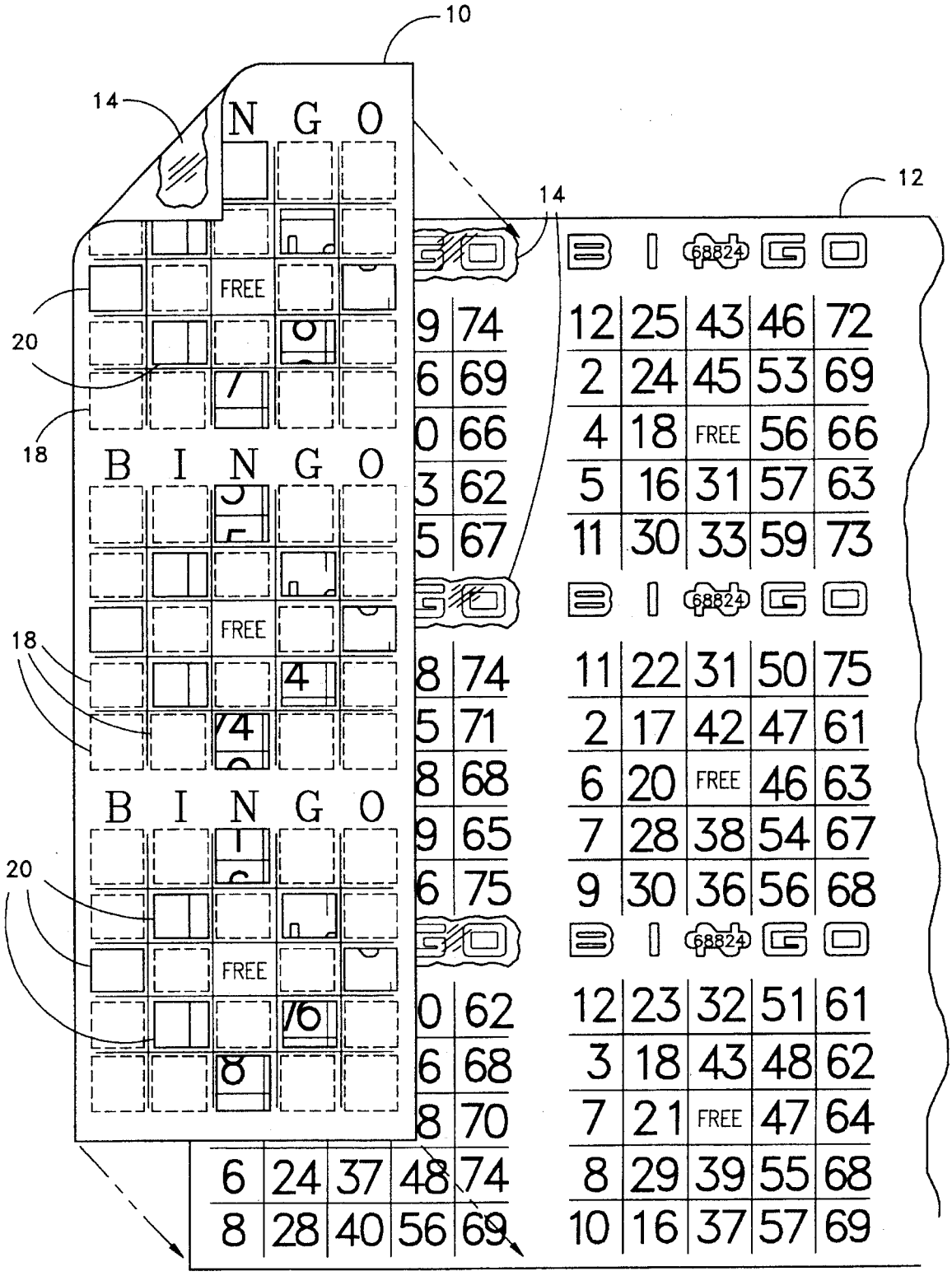
10
12
14
14
20
18
18
20
N G O
FREE
B I N G O
FREE
B I N G O
FREE
B I N G O
68824
68824
68824
6 24 37 48 74
8 28 40 56 69
12 25 43 46 72
2 24 45 53 69
4 18 FREE 56 66
5 16 31 57 63
11 30 33 59 73
11 22 31 50 75
2 17 42 47 61
6 20 FREE 46 63
7 28 38 54 67
9 30 36 56 68
12 23 32 51 61
3 18 43 48 62
7 21 FREE 47 64
8 29 39 55 68
10 16 37 57 69

ADAPTABLE BINGO CARD MARKING STENCIL

BACKGROUND OF THE INVENTION

This invention relates in general to accessories for playing "Bingo" games and, more specifically to an accessory sheet having selectable openings conformable to special game patterns through which a bingo card can be marked.

Bingo is a game that is played with a board containing square block pattern of different numbers, generally five by five. The numbers on each card are printed at random or by some system. Each player obtains one or more sheets each having printed thereon one or more block patterns. A caller calls numbers at random and the player marks each square on the sheets that has a number corresponding to the one called. The person first marking all of the squares on a card corresponding to the pattern being used for that game wins.

Many different patterns may be used. The selected pattern for a given game may be a simple straight line arrangement; vertical, horizontal or diagonal. Many other patterns may be used, such as an "X", "Y", "T", a diamond, a peripheral frame, etc. In each of these, only squares making up the particular pattern are to be marked, with the remaining squares ignored. Where a number of bingo cards are being played simultaneously by a player, it is very difficult to mark only those squares in play and ignore the others and to realize that the pattern in play has been completed on one of the several cards.

A number of different bingo cards have been developed, such as are described by Carney in U.S. Pat. No. 2,191,825 and Herring in U.S. Pat. No. 3,468,541 in which a slide, pivotable tab or the like can be moved to cover a called number. While useful with simple game patterns, they do not overcome the problems in marking only the squares in play with unusual or complex patterns. Also, the tabs or slides are susceptible to being inadvertently moved off of a called number square, so that the player does not realize that a pattern has, in fact, been completed.

Originally, bingo was played with single, individual cards carrying only one game board pattern. To permit players to play several cards simultaneously, attempts have been made to connect individual cards together or to have individual cards with pressure sensitive adhesive backs for temporarily bonding to a backing board, such as is described by Fadner et al. in U.S. Pat. No. 4,618,151. While this kept the individual cards together, this did not meet the problem of unusual game pattern as detailed above.

As players began to play a great number of cards simultaneously, many bingo centers have begun to use paper sheets printed with a plurality, typically a three by three arrangement of none game cards. An ink containing rubber stamping device or "dauber" is used to stamp the square containing each number as numbers are called. The game sheets are discarded upon conclusion of each game. While this makes possible the playing of a large number of games at the same time, since the individual cards could not slide around and the rubber stamp provides the ability to rapidly mark called numbers, the problem of marking only the appropriate squares with an unusual or complex game pattern remains.

McCullen, in U.S. Pat. No. 4,695,057, describes a masking template for covering an entire multi-game sheet, typically a three by three pattern. Each template is prepunched with a pattern of openings corresponding to a particular unusual game pattern. When placed over a multi-game sheet, only those number squares corresponding to the game being played are revealed. This was a considerable improvement over prior bingo accessories.

However, a number of problems remain. A large number of templates must be kept by the player, typically in a three-ring binder, in anticipation of the different game patterns that might be used. Since the game patterns are limited only by the caller's imagination, it would not be reasonably possible to provide every game pattern in such a binder. If a game pattern is called that does not conform with one of the binder templates, the player must either sit that game out or go back to trying to mark only the appropriate squares with no assistance in defining the patterns, either of which would be very aggravating to a fanatic bingo player.

Further, the template to be used must be placed rather precisely over the bingo card sheet being used. The template can rather easily be bumped and displaced during play. Should the template be moved approximately one square to the side or vertically, the displacement may not be noticed until several numbers have been called. This is potentially disastrous for the player if needed numbers have been missed.

Since the bingo card sheets are disposed of after every game, they are generally cheaply printed on low cost stock, usually newsprint. We have found that the space between adjacent number squares varies with different printers and even with different press runs with a single printer. With uniform template opening sizes as shown in the McCullen patent, the outermost rows of number squares may be partly beyond the edge of the template opening, making the number difficult to identify.

Thus, there is a continuing need for improved bingo playing aids for use in playing special or unusual bingo game patterns which display only the game pattern called, that clearly show the numbered squares to be played, that avoid displacement of the aid from the bingo card sheet, are adaptable to new patterns and are useful with a variety of different patterns of game cards on multi-card sheets.

SUMMARY OF THE INVENTION

The above-noted problems, and others, are overcome in accordance with this invention by a bingo playing aid for use with sheets having a plurality of bingo card patterns arranged in rows and columns which includes a stencil sheet having a linear array of at least two bingo card patterns which are spaced apart in accordance with the spacing of card patterns of the sheet with which the aid is to be used.

Perforations are provided around areas corresponding to each number location. Preferably, the perforated areas corresponding to the number locations along the edges of each bingo card pattern in the direction of the linear array are larger than the card number areas to accommodate printing tolerances.

Prior to play, when the caller indicates the game pattern to be used in the next game, the player can easily punch out the corresponding areas on the stencil. Thus, no matter what pattern the caller thinks of and calls, a corresponding stencil can be rapidly prepared.

The stencil can then be placed over the bingo card sheet with the only numbers being revealed being those in play. As revealed numbers are called, a conventional rubber stamp or dauber is used to mark the numbers through the stencil.

The stencil sheet is preferably formed from a plastic material, plastic coated cardstock or the like so that after a game any ink on the stencil can be easily wiped away. The stencil can be kept for use if and when that particular game pattern is called again.

In the method of using this stencil, it is preferred that lines of releasable adhesive be applied along lines between adjacent card patterns on the card sheet, so that the stencil will be releasably held in place during play. Any suitable temporary adhesive may be used, such as rubber cements applied with a ball type application or the waxy adhesives applied with a glue stick type applicator. These adhesives securely hold the stencil in place but easily release it after the short period of a typical bingo game. Any slight amount of adhesive that might transfer to the back of the stencil can be easily wiped or rubbed off.

BRIEF DESCRIPTION OF THE DRAWING

Details of the invention, and of preferred embodiments thereof, will be further understood upon reference to the drawing, wherein the figure is an exploded view showing the relationship of the bingo playing aid to a bingo card sheet.

DETAILED DESCRIPTION OF PREFERRED EMBODIMENTS

Referring now to the FIGURE, there is seen a bingo playing aid including a stencil 10, a bingo card sheet 12 and a thin layer of releasable adhesive 14 for holding stencil 10 and sheet 12 in alignment when brought together.

Bingo card sheet 12 is a conventionally printed sheet having rows and columns of bingo card patterns 16. Conventional sheets 12 have three rows and three or more, often up to six, columns. One stencil 10 is placed over each row. While stencil 10 could include two or more rows, to match exactly a particular sheet 12, the single row of three patterns is preferred since it can be used with sheets 12 having any number of columns. There is no problem with maintaining alignment of plural stencils 10 when the releasable adhesive 14 is used.

Each stencil has a pattern of areas surrounded by perforations 18 which are spaced so as to allow the area to be easily punched out but retain unpunched areas when the stencil is moved or used. In the example shown, the game to be played is a "diamond" pattern with areas 20 forming the diamond pattern punched out.

Since, as discussed above, different printers or printing runs may have slightly different number sizes and the spacing between numbers in each pattern often vary slightly. In a preferred embodiment, the central three rows of perforated areas surrounding the "free" central area, have widths and heights corresponding to the bingo card number patterns. The perforated areas corresponding to the end rows in the direction of the linear array of three bingo card patterns have greater lengths in the direction of the linear array, extending outwardly of the center of the pattern as shown to accommodate those variations. In the embodiment shown, the "taller" perforated areas are the top and bottom rows of each bingo card pattern. If a horizontal stencil were used, covering a horizontal row of bingo card patterns, the left and right end rows of each card pattern would have a greater length in the direction of the linear array of patterns.

In most large, casino-type, bingo centers, a program is provided for each session, listing the game pattern to be used for each game. A player may, if desired, prior to the start of the session take the appropriate number of bingo card sheets and the corresponding number of stencils, punch the stencils with the patterns to be used in the bingo games, apply the releasable adhesive to bingo sheets and adhere the stencils to the sheets in order, producing a stack of combined bingo card sheets and stencils in the order games are to be played. As games are called, the player simply plays the top game, then removes the stencils, discards the game sheet and moves on to the next game. At the start of later sessions, the player can reuse the stencils and create new stencils for any new game patterns.

While certain preferred materials, dimensions and arrangements have been detailed in conjunction with the above description of preferred embodiments, those can be varied, where suitable, with similar results. Other applications, variations and ramifications of this invention will occur to those skilled in the art upon reading this disclosure. Those are intended to be included within the scope of this invention as defined in the appended claims.

I claim:

1. A bingo playing aid for use with playing sheets having a plurality of individual bingo card patterns arranged in rows and columns, which comprises:

a stencil having a linear array of at least two bingo cards patterns extending in a first direction;

said arrayed patterns corresponding to a predetermined spacing of patterns on said playing sheet in one of said rows and columns;

each card pattern on said stencil having perforations surrounding areas corresponding to each number location;

said areas surrounded by perforations corresponding to end rows of bingo card numbers have a greater length in said first direction of said linear array than do areas corresponding to bingo card numbers in interior rows;

whereby selected areas can be removed from said stencil corresponding to the areas to be used in a specific bingo game so that said stencil can be placed over a playing sheet with only those areas on the cards corresponding to the specific game are revealed.

2. The bingo playing aid according to claim 1 wherein said stencil has a plastic coated surface whereby marking material that gets on the stencil during bingo play can be easily wiped away.

3. The bingo playing aid according to claim 1 wherein said stencil includes three adjacent bingo card patterns in a vertical column.

4. The bingo playing aid according to claim 1, further including a layer of pressure sensitive adhesive on at least one of the areas on the playing sheets between adjacent bingo card patterns for releasably holding the stencil in place on the playing sheet during playing of a game.

5. The bingo playing aid according to claim 1, wherein said stencil has a front and a back and further including a layer of pressure sensitive adhesive on at least one of the areas on the back of the stencil between adjacent bingo card patterns for releasably holding the stencil in place on the playing sheet during playing of a game.

* * * * *